United States Patent [19]

Blaese

[11] Patent Number: 4,980,695

[45] Date of Patent: Dec. 25, 1990

[54] SIDE ANTENNA

[76] Inventor: Herbert R. Blaese, 3314 Olcott Ave., Chicago, Ill. 60634

[21] Appl. No.: 440,506

[22] Filed: Nov. 22, 1989

[51] Int. Cl.[5] ..... H01Q 1/32; H01Q 9/00; H01Q 9/38

[52] U.S. Cl. ..... 343/715; 343/745; 343/830; 343/900

[58] Field of Search ..... 343/711, 713, 714, 715, 343/722, 745, 825, 829, 830, 847, 888, 900

[56] References Cited

U.S. PATENT DOCUMENTS

| | | | |
|---|---|---|---|
| 4,238,799 | 12/1980 | Parfitt | 343/715 |
| 4,658,259 | 4/1987 | Blaese | 343/715 |
| 4,764,773 | 8/1988 | Larsen et al. | 343/713 |
| 4,779,098 | 10/1988 | Blaese | 343/715 |
| 4,794,319 | 12/1988 | Shimazaki | 343/715 |
| 4,804,969 | 2/1989 | Blaese | 343/715 |
| 4,825,217 | 4/1989 | Choi | 343/715 |
| 4,839,660 | 6/1989 | Hadzoglou | 343/715 |
| 4,862,183 | 8/1989 | Blaese | 343/715 |
| 4,875,051 | 10/1989 | Blaese | 343/715 |

OTHER PUBLICATIONS

Cellular Mobile, 3dB Gain "On-Class", Antenna Spec. Sheet, Apr. 1985.

*Primary Examiner*—Rolf Hille
*Assistant Examiner*—Peter T. Brown
*Attorney, Agent, or Firm*—Gerstman & Ellis, Ltd.

[57] ABSTRACT

An inside antenna is provided comprising a housing, a capacitor and an inductor located within the housing and cooperating to form an LC network, a radiator connected to the inductor, and a coaxial cable with its central conductor tapped to a selected location of the inductor. The capacitor is formed by a radiator plate to which the radiator and inductor are connected and a ground plate. A set screw is carried by the housing and engages the ground plate so that movement of the set screw varies the position of the ground plate relative to the radiator plate.

8 Claims, 1 Drawing Sheet

SIDE ANTENNA

FIELD OF THE INVENTION

The present invention concerns a novel inside antenna.

BACKGROUND OF THE INVENTION

Mobile antennas, such as cellular antennas, are typically mounted on an exterior surface of a vehicle. While some systems require drilling a hole through a surface of the vehicle for connection of the cable to the antenna, on-glass antennas not requiring the drilling of a hole are in wide use today.

Antennas that are connected to the exterior surface of the vehicle are often damaged or stolen, and some rental car companies do not permit the use of externally mounted antennas. I have discovered a novel antenna that can be mounted on the inside of the vehicle, for example on an inside surface of the vehicle's window, yet which provides effective transmission and reception properties. The antenna that I have discovered is adaptable for any inside use, and it can be mounted on the wall or window of an office or residence, or on any interior surface.

A feature of my invention is that the antenna is relatively simple in construction, so as not to be unsightly.

Therefore, it is an object of the invention to provide an antenna for inside use which is simple in construction and relatively easy to manufacture.

Another object of the present invention is to provide an antenna that can be mounted for inside use yet provides effective reception and/or transmission.

A still further object of the invention is to provide an inside antenna that can be tuned simply.

Another object of the present invention is to provide an inside antenna that can be formed as a compact unit and can be easily mountable on a surface.

Other objects and advantages will become apparent as the description proceeds.

SUMMARY OF THE INVENTION

In accordance with the present invention, an inside antenna is provided which comprises a housing, capacitive means located within the housing, and inductive means located within the housing. The capacitive means and the inductive means cooperate to form an L-C network within the housing.

A radiator having a distal end and a proximal end is provided. The proximal end is located within the housing and the distal end is located outside of the housing. First electrically conductive means couple the proximal end to the inductive means.

An electrical cable is provided, having a main conductor and a ground conductor. Second electrically conductive means connect the main conductor to the inductor means at a location on the inductor means that is spaced from the proximal end connection. Means are provided for varying the impedance of the L-C network and means are provided for mounting the housing on a selected surface.

In the illustrative embodiment, the first electrically conductive means comprises an electrically conductive radiator plate. The proximal end of the radiator is connected to the radiator plate and the inductor means is also connected to the radiator plate.

In the illustrative embodiment, the capacitive means comprises a ground plate having a surface that is generally parallel to the surface of the radiator plate. In this manner, the radiator plate and the capacitive means form electrodes of a capacitor. The varying means comprises means for providing relative movement between the ground plate and the radiator plate and the varying means comprises a screw carried by the housing for engagement with the ground plate.

In the illustrative embodiment, the second electrically conductive means taps a selected location on the inductor means to provide an impedance match. The mounting means comprises either a pressure sensitive adhesive area on the housing or the housing may define apertures to receive mounting screws.

In the illustrative embodiment, the antenna is a voltage fed antenna with the radiator having an electrical length of one-half wave length or a full multiple thereof.

A more detailed explanation of the invention is provided in the following description and claims, and is illustrated in the accompanying drawings.

DETAILED DESCRIPTION OF THE ILLUSTRATIVE EMBODIMENT

Figure 1:
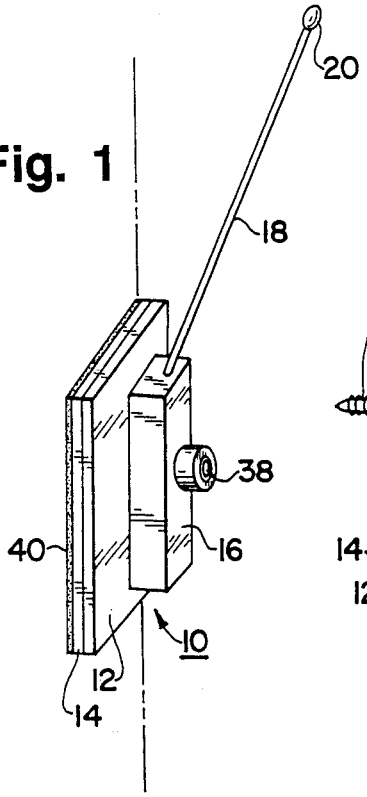
FIG. 1 is a perspective view of an inside antenna constructed in accordance with the principles of the present invention.
Figure 2:
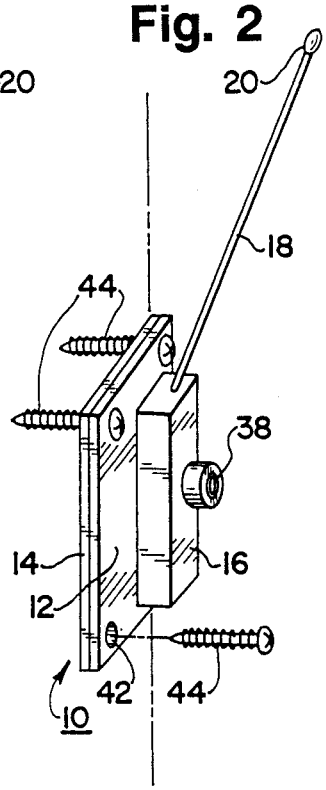
FIG. 2 is a perspective view of another form of an inside antenna constructed in accordance with the principles of the present invention.
Figure 3:
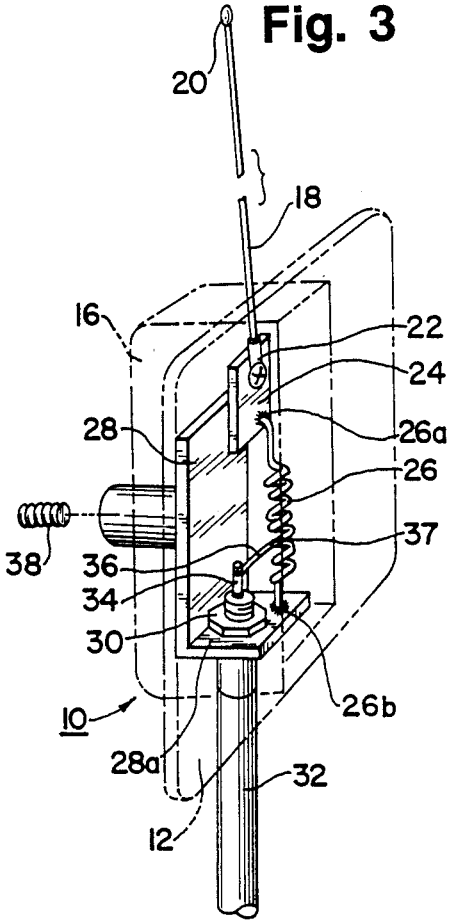
FIG. 3 is a view of the operating elements of the inside antenna of FIGS. 1 and 2.

Referring to FIGS. 1 to 3, an antenna 10 is shown therein comprising a main portion 12 and a mounting portion 14. Portions 12 and 14 are fastened together, preferably by a suitable adhesive.

Main portion 12 has a recessed portion 16 in which the elements illustrated in FIG. 3 are positioned.

An end fed (voltage fed) radiator 18 is provided. Radiator 18 is one-half wave length in electrical length, or a full multiple thereof, such as one wave length, one and a half wave length, two wave lengths, etc., with phase canceling coils between each half wave length. Radiator 18 has a distal end 20 and a proximal end 22. Proximal end 22 is located within the housing and is connected by suitable means to a radiator plate 24. Radiator plate 24 is an electrically conductive member and is generally rectangular in configuration. Also connected to radiator plate 24 by suitable connector means is a coiled inductor 26. Thus one end 26A of inductor 26 is connected to radiator plate 24 and the other end 26B of inductor 26 is connected by suitable connection means to a ground plate 28. Ground plate 28 is an L-shaped member having a surface thereof that is generally parallel to a surface of radiator plate 24. In this manner, ground plate 28 and radiator plate 24 form the electrodes of a capacitor, which cooperates with inductor 26 to form a L-C network.

The base 28A of ground plate 28 is fastened to housing 12 by nut 30 which also serves to connect a coaxial cable 32 to the housing. Coaxial cable 32 has a central conductor 34 and a conventional spaced concentrically surrounding ground conductor (not shown). The ground conductor of coaxial cable 32 is electrically connected to nut 30 and ground plate 28, while the central conductor 34 is connected via an electrically conductive extension 36 to a tapped location 37 of inductor 26.

In the illustrative embodiment, although no limitation is intended, radiator 20 is a 14.5 inch whip, radiator plate 24 has a width of ⅝ inch and a length of 15/16 inch, inductor 26 has 11 turns and is tapped 2.5 turns from end 26B, and ground plate 28 has a height of 1.75 inches.

A set screw 38 is mounted within recessed portion 16 and engages ground plate 28. In order to tune the L-C network, set screw 38 is turned to move ground plate 28 toward or away from radiator plate 24. This varies the capacitance of the L-C circuit.

The impedance of the antenna is matched at the factory by tapping central conductor 34 of coaxial cable 32 to the appropriate location on inductor 26.

In the form of the invention illustrated in FIG. 1, mounting portion 14 is provided with a pressure sensitive adhesive surface 40, covered by a paper or plastic member. The paper or plastic member may be peeled off and the adhesive surface allows the housing to be mounted to a suitable surface.

In the form of the invention illustrated in FIG. 2, housing 12 defines apertures 42. These apertures receive screws 44 which enable the housing 12 to be mounted on a suitable surface.

Figure 4:
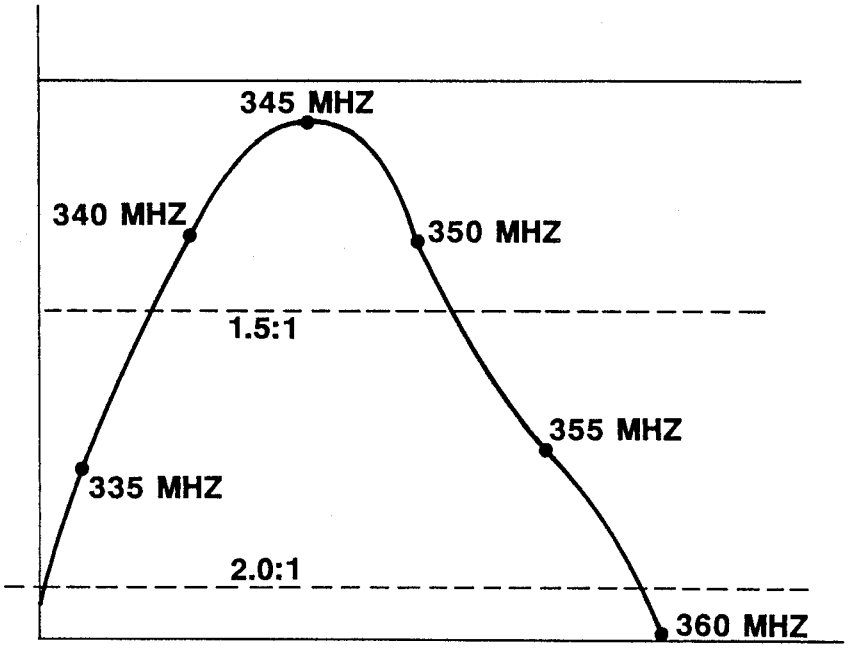
FIG. 4 is a standing wave ratio diagram of an antenna constructed in accordance with the principles of the present invention.

It is preferred that the housing be mounted on a vertical surface and that radiator 18 extend substantially vertically. A voltage standing wave ratio diagram is illustrated in FIG. 4 for a specific example wherein the antenna was tuned for 345 mHz. FIG. 4 shows that the antenna handled from 335 mHz through 355 mHz very effectively. The bandwidth can be altered by changing the L-C ratio, for example by adding more coil turns on the inductor thereby reducing the capacitance. In this manner, there would be less capacitance needed for resonance and the bandwidth would increase. On the other hand, if a narrow bandwidth is desired, less coil turns on the inductor would be used for increased capacitance.

By attaching the antenna to a wall or window, the antenna can be extended in the appropriate direction for best effective matching of the polarization. Further, the antenna can be located in an effective area for reception and transmission, making the antenna particularly useful for the inside of a vehicle.

In the illustrative embodiment, the radiator, radiator plate, inductor and ground plate are formed of copper although it is understood that various electrically conductive materials may be used. Although illustrative embodiments of the invention have been shown and described, it is to be understood that various modifications and substitutions may be made by those skilled in the art without departing from the novel spirit and scope of the present invention.

What is claimed is:

1. An inside antenna which comprises:

a housing;

capacitive means located within the housing;

inductive means located within the housing;

said capacitive means and said inductive means cooperating to form an L-C network within the housing;

a radiator having a distal end and a proximal end, said proximal end located within the housing and said distal end located outside of the housing;

a first electrically conductive means coupling said proximal end to said inductive means;

an electrical cable having a main conductor and a ground conductor;

said capacitive means comprising a ground plate that is electrically connected to said ground conductor;

means for varying the impedance of L-C network, said varying means comprising means for varying said ground plate to change its position relative to said first electrically conductive means;

second electrically conductive means connecting said main conductor to said inductor means at a location on said inductor means that is spaced from said proximal end connection to said inductor means, said second electrically conductive means tapping a selecting location on the inductor means to provide an impedance match;

means for mounting the housing on a selective surface; and said varying means comprising a screw carried by the housing for engagement with said ground plate.

2. An inside antenna as defined by claim 1, said first electrically conductive means comprising an electrically conductive radiator plate, means connecting said proximal end to said radiator plate and means connecting said inductor means to said radiator plate.

3. An inside antenna as defined by claim 2, said capacitive means comprising a ground plate having a surface that is generally parallel to a surface of said radiator plate, whereby said radiator plate and said capacitive means form electrodes of a capacitor.

4. An inside antenna as defined by claim 3, said varying means comprising means for providing relative movement between said ground plate and said radiator plate.

5. An inside antenna as defined by claim 1, said mounting means comprising a pressure sensitive adhesive area on said housing.

6. An inside antenna as defined by claim 1, said mounting means comprising apertures defined by said housing to receive mounting screws.

7. An inside antenna as defined by claim 1, said radiator having an electrical length of one-half wave length or a full multiple thereof.

8. An inside antenna as defined by claim 1, said electrical cable comprising a coaxial cable with said main conductor comprising the central conductor and said ground conductor comprising a spaced, concentrically surrounding conductor.

* * * * *